US007481556B2

(12) United States Patent
Yarrington

(10) Patent No.: US 7,481,556 B2
(45) Date of Patent: Jan. 27, 2009

(54) APPARATUS AND METHODS FOR MANUFACTURING A HIGH VOLTAGE TO LOW VOLTAGE LIGHTING FIXTURE ADAPTER

(76) Inventor: Robert Wilson Yarrington, 360 Whitly Bay Ave., Las Vegas, NV (US) 89148

( * ) Notice: Subject to any disclaimer, the term of this patent is extended or adjusted under 35 U.S.C. 154(b) by 210 days.

(21) Appl. No.: 11/495,120

(22) Filed: Jul. 28, 2006

(65) Prior Publication Data

US 2007/0035254 A1 Feb. 15, 2007

Related U.S. Application Data

(60) Provisional application No. 60/707,449, filed on Aug. 11, 2005.

(51) Int. Cl.
*F21V 14/00* (2006.01)

(52) U.S. Cl. ..... 362/255; 362/640; 362/644

(58) Field of Classification Search ..... 362/640, 362/652–654, 255, 806; 439/236
See application file for complete search history.

(56) References Cited

U.S. PATENT DOCUMENTS

| | | | | |
|---|---|---|---|---|
| 4,858,089 | A * | 8/1989 | Pietro | 362/294 |
| 6,796,698 | B2 * | 9/2004 | Sommers et al. | 362/555 |
| 7,038,399 | B2 * | 5/2006 | Lys et al. | 315/291 |
| 7,178,970 | B2 * | 2/2007 | Chiu | 362/654 |
| 7,301,499 | B2 * | 11/2007 | Shin et al. | 343/700 MS |
| 2005/0135107 | A1 * | 6/2005 | Currie et al. | 362/382 |
| 2006/0232974 | A1 * | 10/2006 | Lee et al. | 362/294 |

* cited by examiner

*Primary Examiner*—Ali Alavi
(74) *Attorney, Agent, or Firm*—The Patel Law Firm, P.C.; Natu J. Patel

(57) ABSTRACT

A method and an apparatus that enables converting a high voltage lighting fixture for use with a low voltage lighting system are disclosed. The method comprises providing a housing having a cavity, providing a low voltage light source socket having two electrical contacts having sufficient spacing to accommodate a low voltage light source, each electrical contact connected a first and a second conductor respectively, electrically connecting the first conductor to an interior thread contact and the second conductor to an interior base contact, and securing the first and second conductors and the low voltage light source socket within the housing.

5 Claims, 8 Drawing Sheets

APPARATUS AND METHODS FOR MANUFACTURING A HIGH VOLTAGE TO LOW VOLTAGE LIGHTING FIXTURE ADAPTER

This utility patent application claims the benefit of the filing date of U.S. provisional patent application Ser. No. 60/707,449 filed Aug. 11, 2005, entitled Apparatus and Methods for Manufacturing a High Voltage to Low Voltage Lighting Fixture Adapter, the entire content of which provisional application is hereby incorporated herein in its entirety by this reference.

COPYRIGHT NOTICE

A portion of the disclosure of this patent document contains material that is subject to copyright notice. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates generally to light fixtures that are employed in outdoor settings and more specifically to a method for manufacturing a high voltage to low voltage lighting fixture adapter.

Outdoor lighting comes in a wide range of designs to suit different needs and to create different lighting effects. Outdoor lighting is used to illuminate roadways, parking lots, yards, sidewalks, public meeting areas, signs, work sites, and buildings. It provides better visibility and a sense of security, while also having the ability to set the mood of an event.

Most fixtures are available in either low voltage or high voltage versions 115-volts is considered high voltage for the purpose of this application. Although high voltage lighting fixtures are ideal for outdoor use, the hazards and precautions associated with their use may outweigh their benefits. In the lighting industry, there is a strong desire to utilize safer, low voltage lighting systems while at the same time being able to utilize higher quality, high voltage lighting fixtures. One way of satisfying this desire is to manufacture an apparatus that utilizes the wiring of high voltage lighting fixtures for use with low voltage lighting systems.

High voltage lighting fixtures that are commercially available are more expensive than low voltage lighting fixtures and are made of higher quality materials than their low voltage counterparts. High voltage lighting fixtures have various safety hazards that must be taken into consideration. High voltage lighting fixtures also require permits from city or other governmental agencies before installation. Their installation costs can be as high as ten times the installation costs of the low voltage lighting systems. High voltage lighting fixtures need to be installed according to code, which require utilizing weatherproof boxes and burying electrical conduit or direct burial cable 18 inches or more below the ground. Currently, there is no way to completely avoid the possibility of safety hazards associated with high voltage systems and lighting fixtures.

Low voltage lighting systems and fixtures have several distinct advantages over the high voltage lighting systems and fixtures. One of which is that low voltage systems run on harmless levels of voltage, converted by a transformer connected to a high voltage source. Safe, low voltage wiring is relatively lightweight and can be laid directly on the ground or buried just below the surface of the ground. It is neither necessary nor required to hire a licensed electrician or to obtain permits for installation. Low voltage lighting systems and fixtures are safe in wet conditions and do not possess an electrical shock hazard. Additionally, low voltage fixtures are energy efficient, operating at one third of the cost of high voltage lighting fixtures.

It is easy to understand why there is such a large market for low voltage outdoor lighting systems compared to high voltage lighting fixtures. However, while there is a high demand for low voltage lighting systems, low voltage lighting fixture options are generally inferior to the options offered by high voltage lighting fixtures. Low voltage lighting fixtures are usually made of plastic or cheaply manufactured material and lack artistic value. In contrast, high voltage lighting fixtures vary in manufacturing materials, design and style, and are solidly constructed to adhere to strict standards and conform to city and governmental codes to meet high voltage electrical system safety requirements.

It is therefore desirable to have an invention that would enable the use of high voltage lighting fixtures with low voltage lighting systems.

SUMMARY OF THE INVENTION

An apparatus and a method that makes it possible to convert a high voltage lighting fixture for use with a low voltage lighting system are disclosed. In one embodiment, the method for manufacturing a 115-volt to low voltage lighting fixture adapter includes providing a housing with a cavity having an interior base contact and a interior thread contact, supplying a low voltage light source socket having two electrical contacts wherein each electrical contact is connected to a first conductor and a second conductor respectively, electrically connecting the first conductor to the interior thread contact and the second conductor the interior base contact, and securing the first conductor, the second conductor and the low voltage light source socket within the cavity of the housing.

In one embodiment, the housing may be provided by modifying a commercially available fuse (Edison Base), which is of sufficient size and shape to fit into the high voltage lighting fixture. Furthermore, the method includes obtaining the low voltage light source socket with two electrical conductors having sufficient spacing between the terminals to accommodate the desired low voltage light source (i.e. low voltage light bulb). In addition, the method includes performing continuity tests to ensure that there is no short circuit within the electrical device.

One object of the invention is to provide a method of manufacture for an adapter facilitating the use of high voltage lighting fixtures with low voltage lighting systems for safety and economy purposes. The method of manufacture can be facilitated by the use of commercially available parts and modifying them accordingly. Another object is to enable the installation of high quality outdoor lighting fixtures, normally reserved for use in high voltage lighting system installations, without the necessity of obtaining installation permits from city or other governmental agencies and contracting with a licensed electrician.

There has thus been outlined, rather broadly, the more important features of the invention in order that the detailed description thereof may be better understood, and in order that the present contribution to the art may be better appreciated. There are additional features of the invention that will be described hereinafter.

BRIEF DESCRIPTION OF THE DRAWING

To the accomplishment of the above and related objectives, this invention may be embodied in the form illustrated in the accompanying drawings, attention being called to the fact, however, that the drawings are illustrative only, and that changes may be made in the specific construction and method illustrated.

DETAILED DESCRIPTION OF THE INVENTION

Various embodiments of methods and the structure of the high voltage to low voltage lighting fixture adapter are not limited to the specific embodiments described herein.

Figure 1:
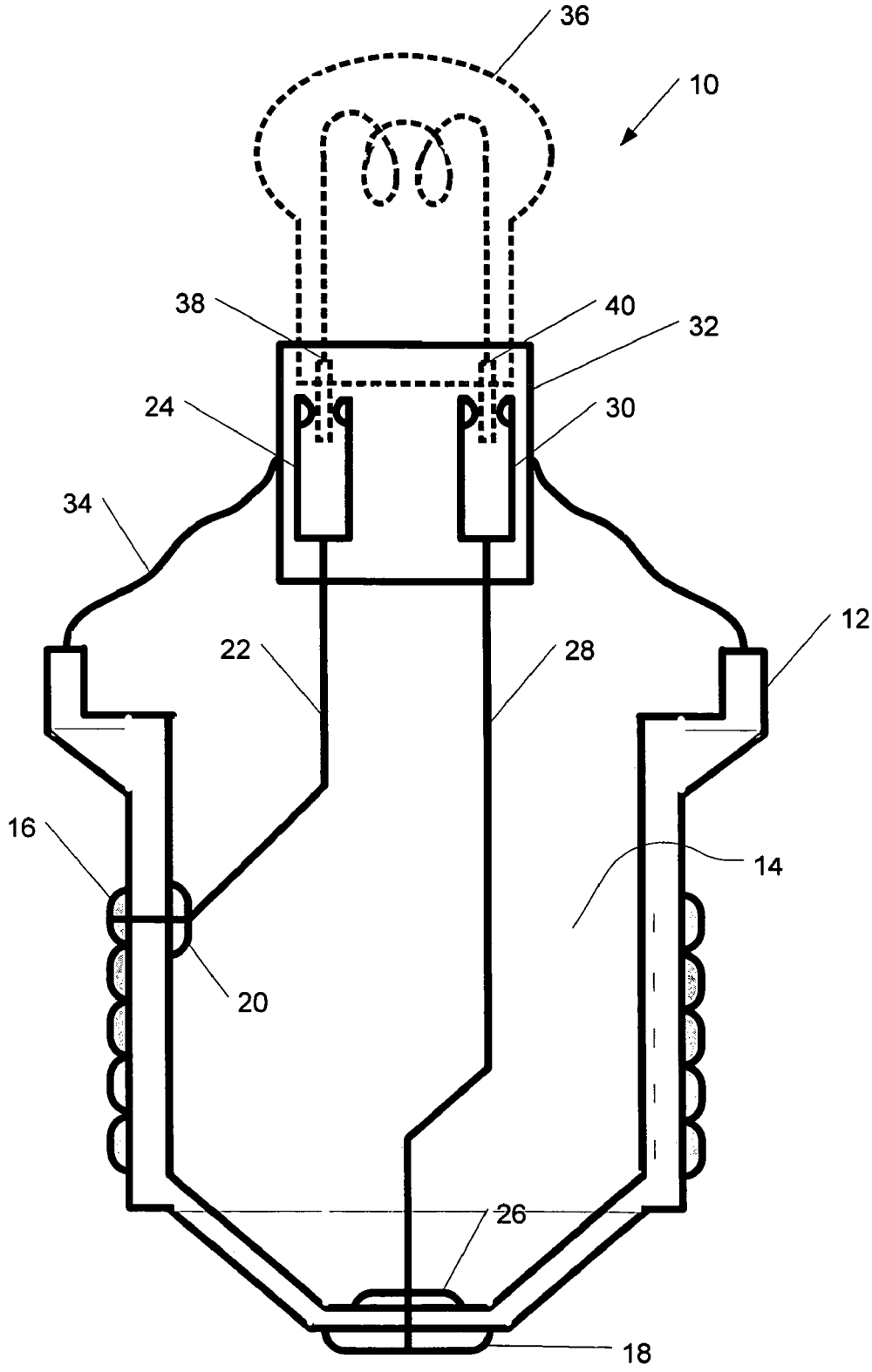
FIG. 1 is a cross-sectional view of a high voltage to low voltage power adapter.
Figure 4:
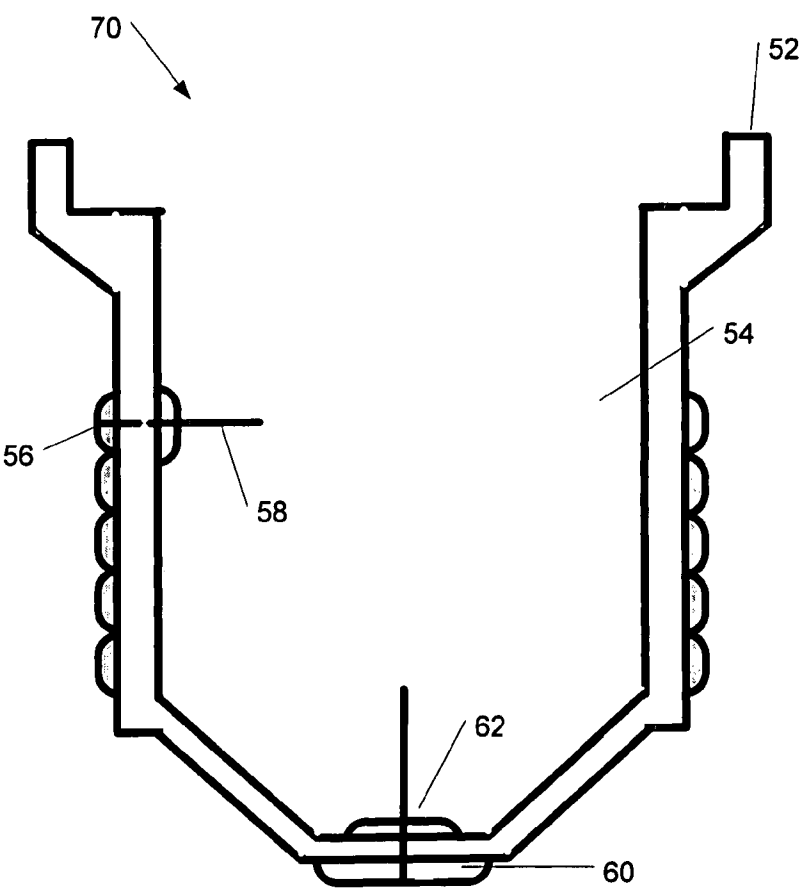
FIG. 4 is a cross-sectional view of a modified high voltage fuse to be utilized as the housing for the power adapter shown in FIG. 1.
Figure 3:
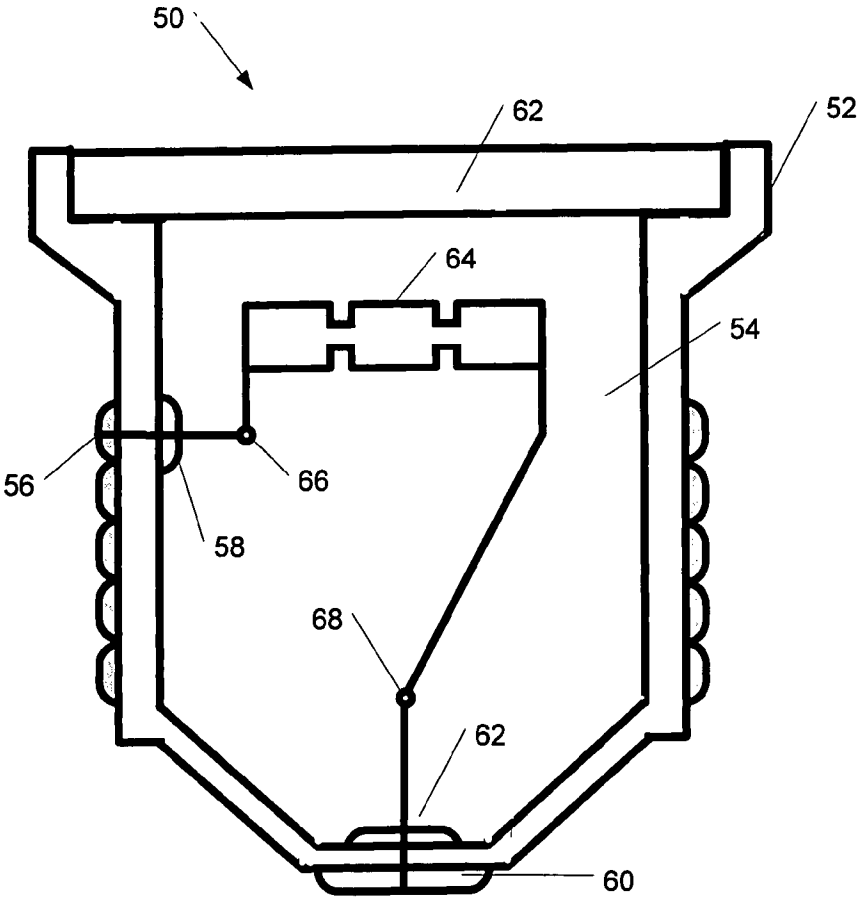
FIG. 3 is a cross-sectional view of a commercially available high voltage fuse that can be utilized to manufacture the housing for the power adapter.

FIG. 1 is a cross-sectional view of a high voltage to low voltage power adapter 10. In one embodiment, power adapter 10 includes a housing 12, having a cavity 14. As illustrated in FIGS. 3 and 4 below, housing 12 can be supplied by modifying commercially available fuses.

Housing 12 includes an exterior thread contact 16, an exterior base contact 18, an interior thread contact 20 and an interior base contact 26. Exterior thread contact 16 is conductively connected to interior thread contact 20 to provide an electrical continuity. A first end of a first conductor 22 is soldered to interior thread contact 20, while a second end of first conductor 22 is crimped or soldered to a first electrical contact 24. This provides electrical continuity from exterior thread contact 16 to first electrical contact 24 by utilizing first conductor 22. Exterior base contact 18 is conductively connected to an interior base contact 26 to provide an electrical continuity. A first end of a second conductor 28 is soldered to interior base contact 26, while a second end of second conductor 28 is crimped or soldered to a second electrical contact 30. This provides electrical continuity from exterior base contact 18 to second electrical contact 30 by utilizing second conductor 28. First and second electrical contacts 24 and 30 could be referred to as first and second electrical terminals.

Figure 6:
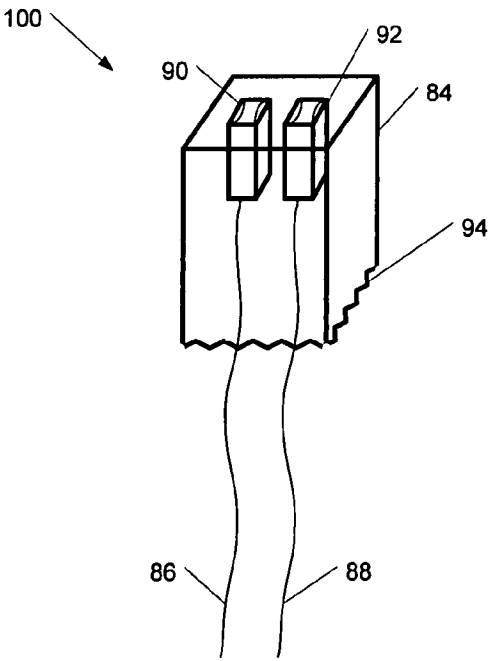
FIG. 6 is a perspective view of a separated socket portion to be used in the manufacturing of the power adapter shown in FIG. 1.
Figure 5:
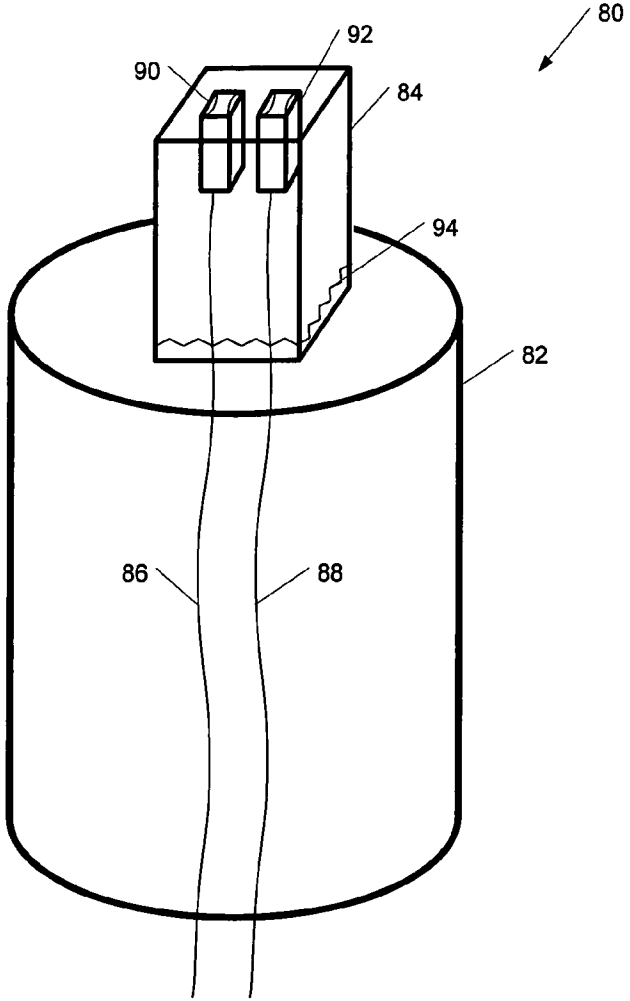
FIG. 5 is a perspective view of a commercially available low voltage lighting fixture socket assembly to be used in the manufacturing of socket for the power adapter shown FIG. 1.

First electrical contact 24 and second electrical contact 30 are encased securely in a low voltage light source socket 32. As illustrated in FIGS. 5 and 6 below, light source socket 32 is manufactured by modifying a commercially available low voltage lighting fixture. It can be appreciated that various models of low voltage lighting fixtures exist, but the electrical circuits of all low voltage lighting fixtures are the same, thereby allowing any fixture to be modified for similar use.

As illustrated in FIG. 1, socket 32 is positioned mostly outside of cavity 14 and is secured centrally within housing 12 by utilizing an epoxy mixture 34. FIG. 1 further illustrates a low voltage light source 36 having first and second contact points 38 and 40 inserted within first and second electrical contacts 24 and 30 respectively. In a further embodiment, socket 32 can be independently manufactured or modified by utilizing the commercially available components as long as electrical contacts 24 and 30 are configured to accommodate contact points 38 and 40 of light source 36.

Figure 2:
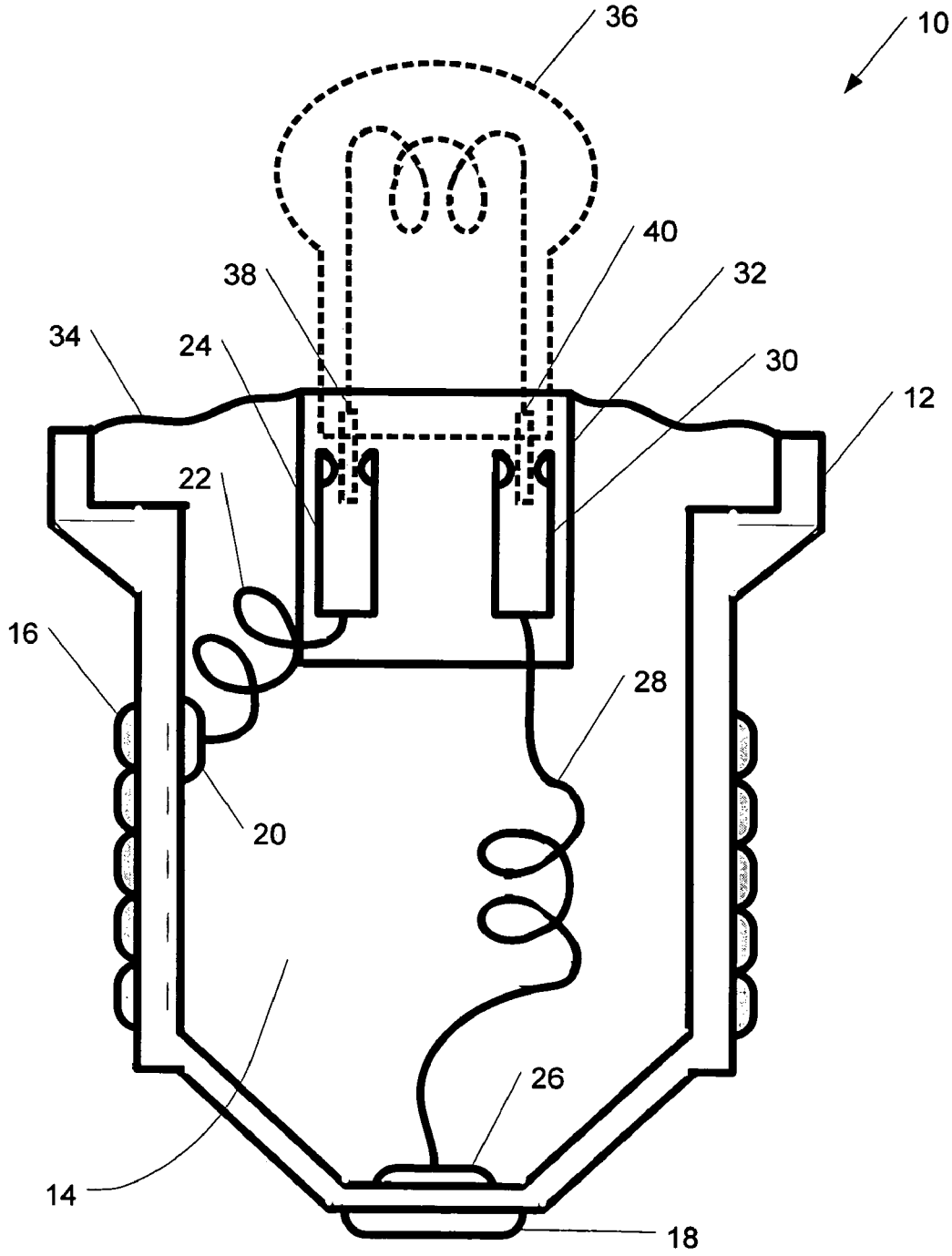
FIG. 2 is a cross-sectional view of an alternate embodiment of the power adapter.

FIG. 2 is a cross-sectional view of an alternate embodiment of power adapter 10. In this embodiment, socket 32 is positioned partially inside cavity 14. First and second conductors 22 and 28 are coiled within cavity 14 to create sufficient space to accommodate socket 32, which is then secured utilizing epoxy mixture 34. In one embodiment, commercially available epoxies of appropriate types, such as Side A Resin and Side B Hardener (Eclectic Products, Inc.'s Part Nos. 0445100 and 0445200 respectively) are used to create epoxy mixture 34. Glue, resin, molded plastic or other appropriate type of epoxies that are suitable for outdoor and possible moist environment could be utilized as epoxy mixture 34 to secure socket 32 within housing 12.

FIG. 3 is a cross-sectional view of a commercially available high voltage fuse 50 that can be utilized to manufacture housing 12 for power adapter 10. Fuse 50 is commercially available from any general hardware store and can be modified as illustrated below. In one embodiment, commercially available fuse 50 includes a housing 52 having a cavity 54, an exterior thread contact 56 conductively connected to an interior thread contact 58, an exterior base contact 60 conductively connected to an interior base contact 62, a top cap portion 63, and a fuse metal 64 conductively connected by a pair of contact points 66 and 68. Contact points 66 and 68 indicate a position where fuse metal 64 is separated. Fuse 50 is modified by separating fuse metal 64 from the interior thread contact 58 and interior base contact 62. Separation can be accomplished by cutting, tearing, and breaking or by utilizing any other means commercially available. Once removed, fuse metal 64 is safely discarded. After fuse 50 is modified, it is utilized as a housing to manufacture the power adapter 10 shown above in FIG. 1.

FIG. 4 is a cross-sectional view of a modified high voltage fuse 70 to be utilized as housing for power adapter 10 shown in FIG. 1. FIG. 4 illustrates fuse 50 (shown in FIG. 3) after the modifications. Housing 52 is utilized to hold a low voltage lighting socket. Although housing 52 is manufactured by modifying a commercially available high voltage fuse 50, it can be appreciated that the housing for power adapter 10 can also be manufactured from raw materials preferred for such application by utilizing manufacturing methods such as molding, casting and like.

FIG. 5 is a perspective view of a commercially available low voltage lighting fixture socket assembly 80 to be used in the manufacturing of socket for power adapter 10 shown in FIG. 1. In one embodiment, commercially available components sold with low voltage lighting fixtures by Intermatic Incorporated (Part Nos. ML10401/LX1, ML30403/LX3, ML40404/LX4) are utilized to manufacture socket 32. Low voltage lighting fixture and/or socket assembly 80 is commercially available from any general hardware store. Although socket 32 is manufactured by modifying a commercially available low voltage lighting fixtures and/or socket assembly 80, it can be appreciated that socket 32 for power adapter 10 can also be manufactured from raw materials preferred for such application by utilizing manufacturing methods such as molding, casting and like.

The commercially available low voltage lighting fixture socket assembly 80 includes a cylindrical base portion 82 seamlessly connected to a socket portion 84, first and second conductors 86 and 88 coupled to first and second electrical contacts 90 and 92 respectively. Socket portion 84 consists of first and second electrical contacts 90 and 92 secured within the socket portion and two conductors connected thereto. FIG. 5 illustrates a recommended location 94 at which body portion 82 and socket portion 84 are separated. Separation of socket portion 84 from base portion 82 can be accomplished by cutting, tearing, and breaking or by utilizing any other means commercially available. In one embodiment, socket portion 84 may be separated by utilizing a saw. Precautions are taken to ensure conductors 86 and 88 are not incidentally cut during the modification. Conductors 86 and 88 may be removed from socket portion 84 prior to separating socket portion 84 from base portion 82.

FIG. 6 is a perspective view of a separated socket portion 84 to be used in the manufacturing of power adapter 10 shown in FIG. 1. As illustrated, socket portion 84 includes first and second conductors 86 and 88 conductively coupled to first and second electrical contacts 90 and 92 respectively, and encased in socket portion 84.

Figure 7:
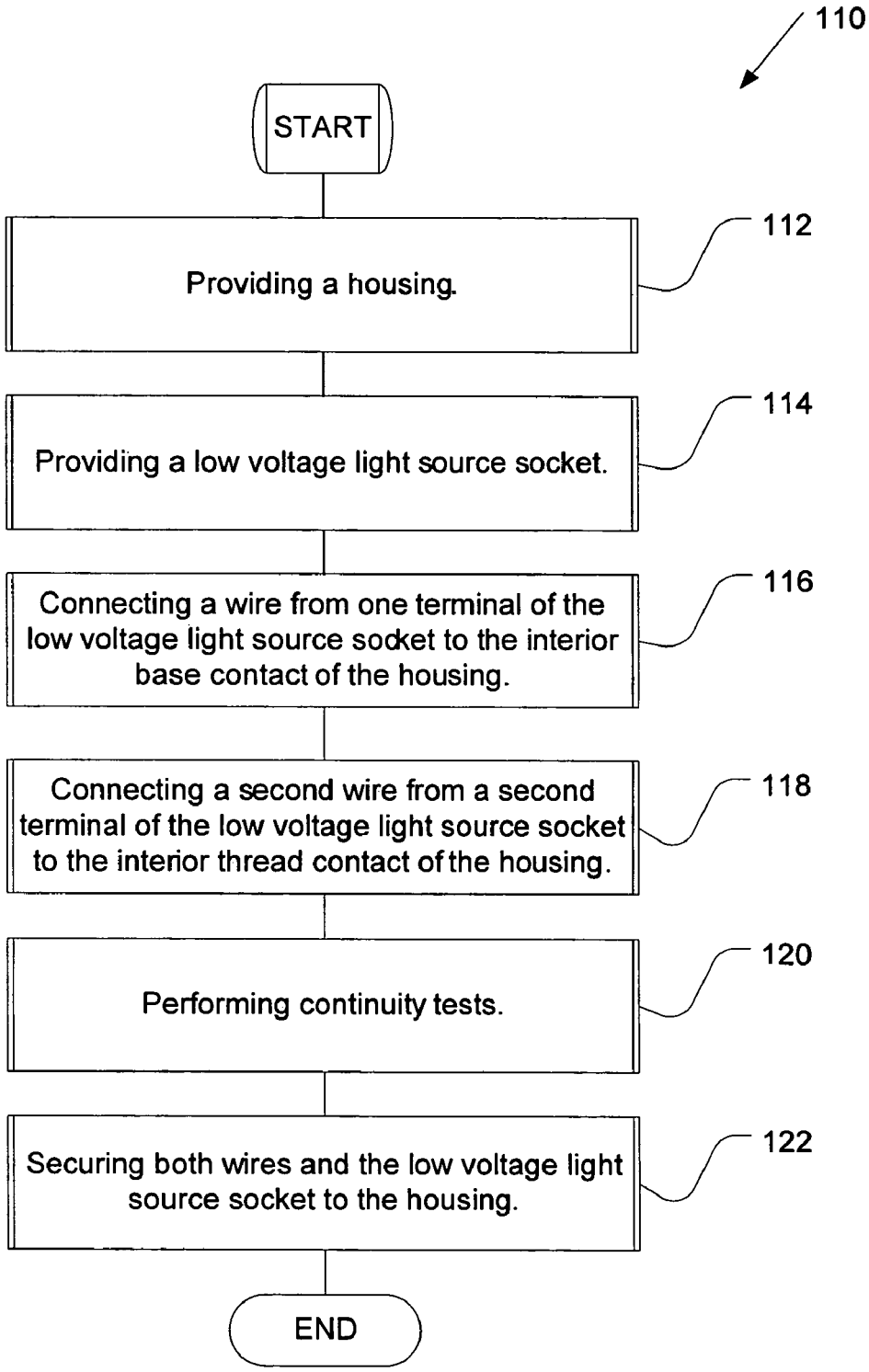
FIG. 7 is a flow chart illustrating a method for manufacturing the power adapter.

FIG. 7 is a flow chart illustrating a method 110 for manufacturing power adapter 10. Method 110 includes providing 112 a housing 12 (shown in FIG. 1) having a cavity. In one embodiment, the housing is manufactured by obtaining a commercially available Edison base type fuse (illustrated above in FIGS. 3 and 4). First, the top cap portion of the fuse is removed. Then, the fuse metal inside of the fuse is severed from the interior base contact and the interior thread contact. It can be appreciated that other Edison base type items that are commercially available can be modified to achieve similar results.

Once the housing is available, low voltage light source socket 32 (shown in FIG. 1) is supplied 114 by modifying a commercially available low voltage lighting fixture socket assembly 80 (as illustrated in FIGS. 5 and 6 above).

Socket assembly 80 has a socket portion connected to a base portion. Socket portion consists of two electrical contacts secured inside the socket portion and two conductors connected thereto. The socket portion is then separated from the base portion as illustrated in FIGS. 5 and 6 above. Sufficient conductor lengths for both the conductors are allowed to accommodate the soldering process while maintaining a length that can fit into the cavity of the housing.

After socket 32 (shown in FIG. 1) is provided, method 110 further includes connecting the first conductor 116 from the socket to the interior thread contact of the housing and connecting the second conductor 118 from the socket to an interior base contact located inside the housing. Connecting the first conductor and second conductor can be accomplished by soldering to ensure electrical continuity. However, connecting may also be achieved by utilizing wire nuts, quick connects, wire connectors, twisting, and welding.

Continuity test is performed 120 to ensure that no short circuit conditions exist and that the electrical connections are secure at all connection points.

Method 110 further includes securing 122 the first conductor, the second conductor and the socket within the housing. Securing these components is accomplished by utilizing commercially available appropriate epoxy mixture, glue, resin or molded plastic (as described above). The method described above need not be performed in the order described.

Figure 8:
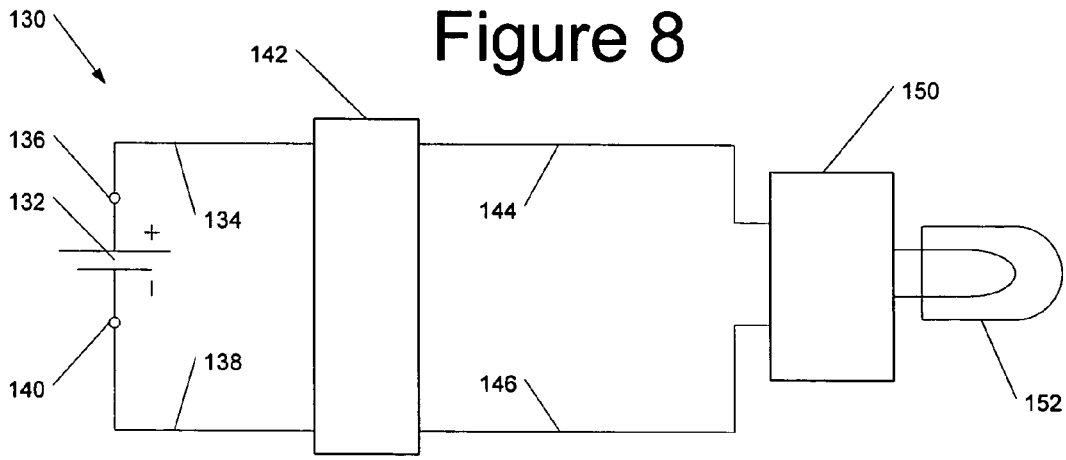
FIG. 8 is a schematic diagram implementing a low voltage lighting system utilizing power adapter shown in FIG. 1.
Figure 10:
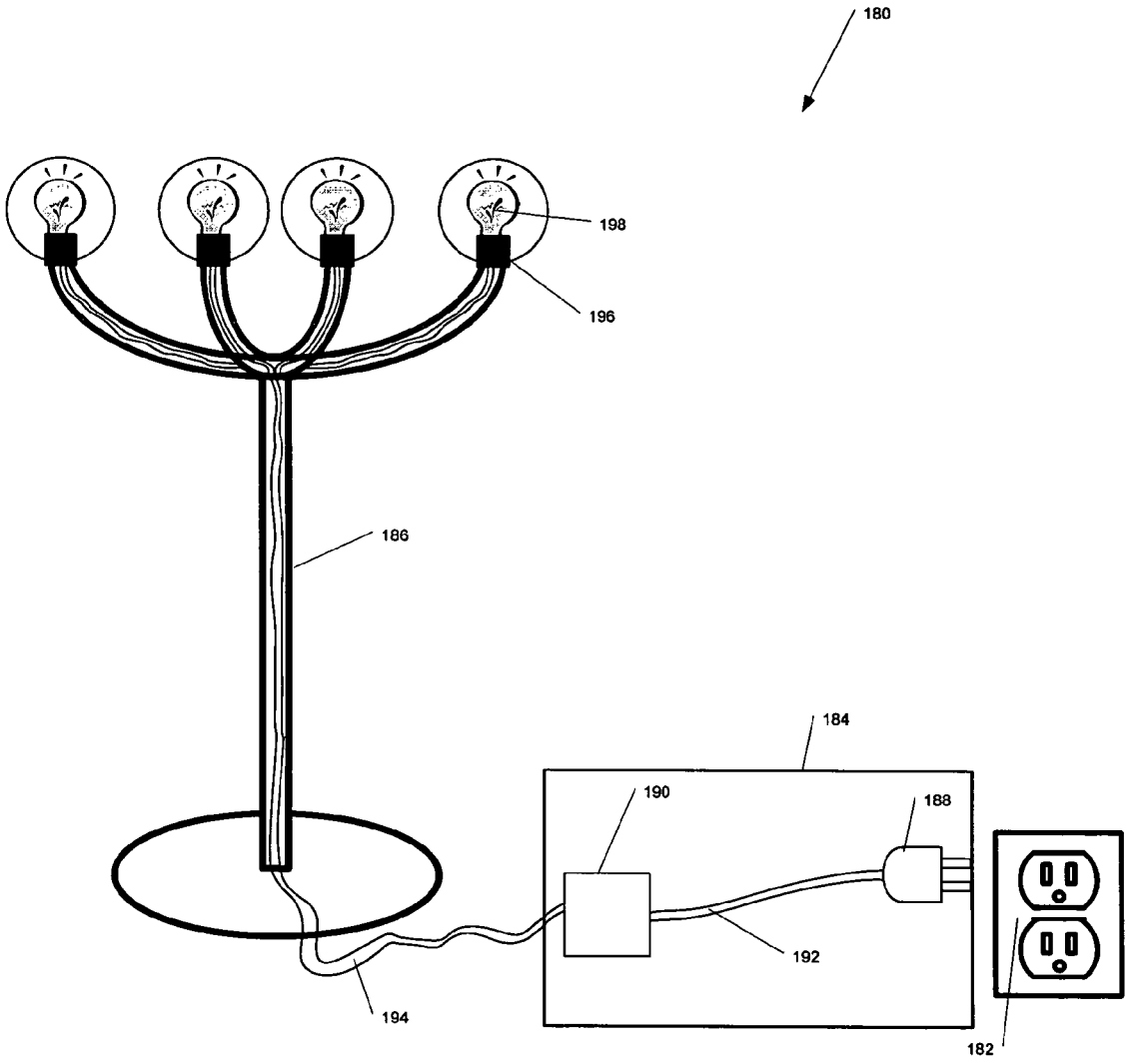
FIG. 10 illustrates a lighting system, which includes a commercially available low voltage power supply assembly (i.e. transformer) and a modified high voltage lighting fixture.
Figure 11:
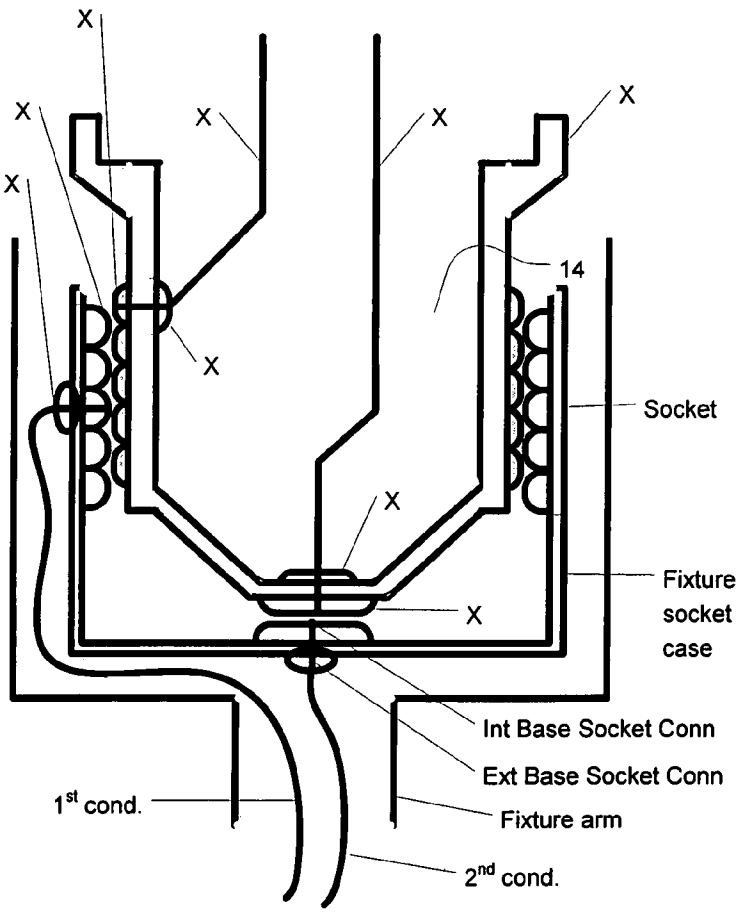
FIG. 11 is a cross-sectional view of a high voltage lighting fixture illustrating housing of the power adapter shown in FIG. 1.

FIG. 8 is a schematic diagram implementing a low voltage lighting system 130 utilizing power adapter 10 (shown in FIG. 1). System 130 includes power adapter 10 electrically connected to a low voltage power supply assembly (i.e. transformer) 142, which is in turn connected to a standard outdoor electrical outlet having a positive, negative and ground terminal. Transformer 142 converts high voltage into low voltage for use in low voltage lighting system 130. Transformer 142 has first and second outputs 134 and 136. First and second outputs 134 and 136 are electrically connected to first and second conductors 144 and 146 respectively. First and second conductors 144 and 146 are electrically connected to exterior thread contact 16 and exterior base contact 18 respectively to provide required electrical power to adapter 10 to illuminate light source 36 (as illustrated in FIG. 10). It can be appreciated that first and second conductors 144 and 146 can also be electrically connected directly to first and second conductors 22 and 28 respectively to provide required electrical power to illuminate light source 36 (as illustrated in FIG. 11). This arrangement eliminates a need for having housing 12 as illustrated in FIG. 11. Connecting conductors 144 and 146 in this manner does not change the circuitry illustrated in FIG. 8.

Figure 9:
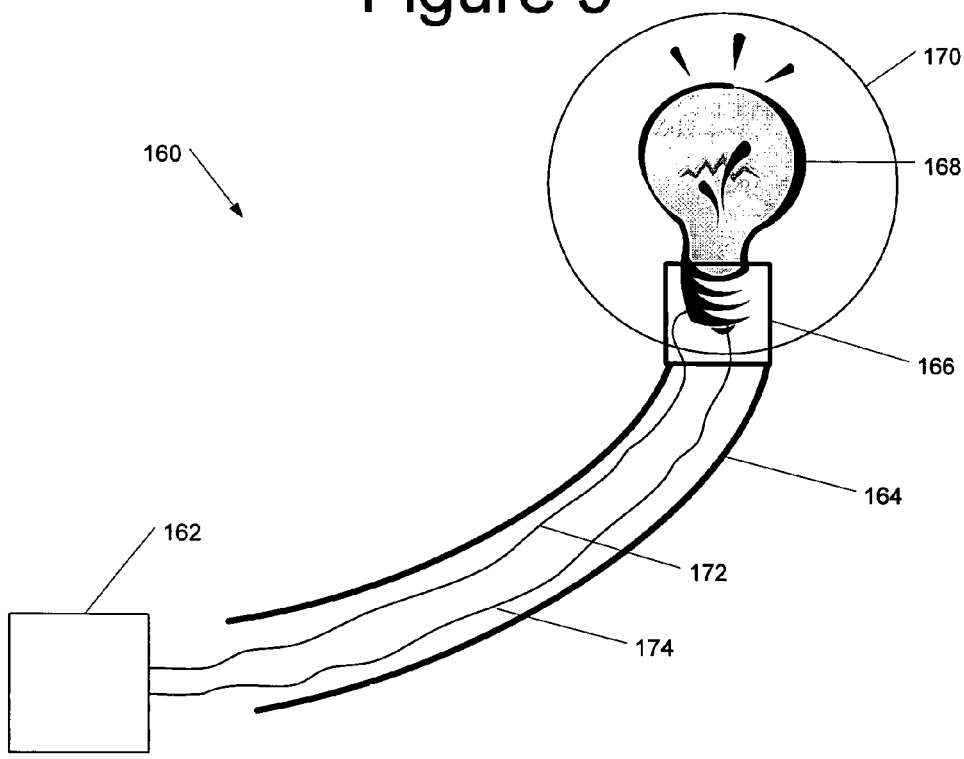
FIG. 9 is a perspective view of the lighting system, including the power adapter.

FIG. 9 is a perspective view of lighting system 130 shown in FIG. 8 above. As shown, a fixture arm 164 carries first and second conductors 144 and 146. Further more, a protective light cover 170 is provided to protect light source 36.

FIG. 10 illustrates a lighting system 180, which includes a commercially available low voltage power supply assembly (i.e. transformer) 142 and a modified high voltage lighting fixture 186. Modified fixture 186 includes a plurality of high voltage to low voltage light fixture adapters 192, 194, 196, 198 (not shown) and a plurality of light sources 202, 204, 206, and 208. Each plurality of light fixture adapters 192, 194, 196, 198 are secured in their corresponding light fixture sockets 212, 214, 216, 218. Each respective fixture socket has two electrical feed conductors (a total of 8 in this configuration). It can be appreciated that the modified lighting fixture electrical feed conductors are to be connected to transformer 142 cable in a proper polarity. These connections can be made by utilizing wire nuts, soldering, copper crimp butt connectors and the like and must be properly insulated. Transformer 142 is connected to a standard electrical outlet 182 by utilizing a standard three prong electrical plug 188.

FIG. 11 is a cross-sectional view of a high voltage lighting fixture illustrating housing 10 of the power adapter shown in FIG. 1.

Figure 12:
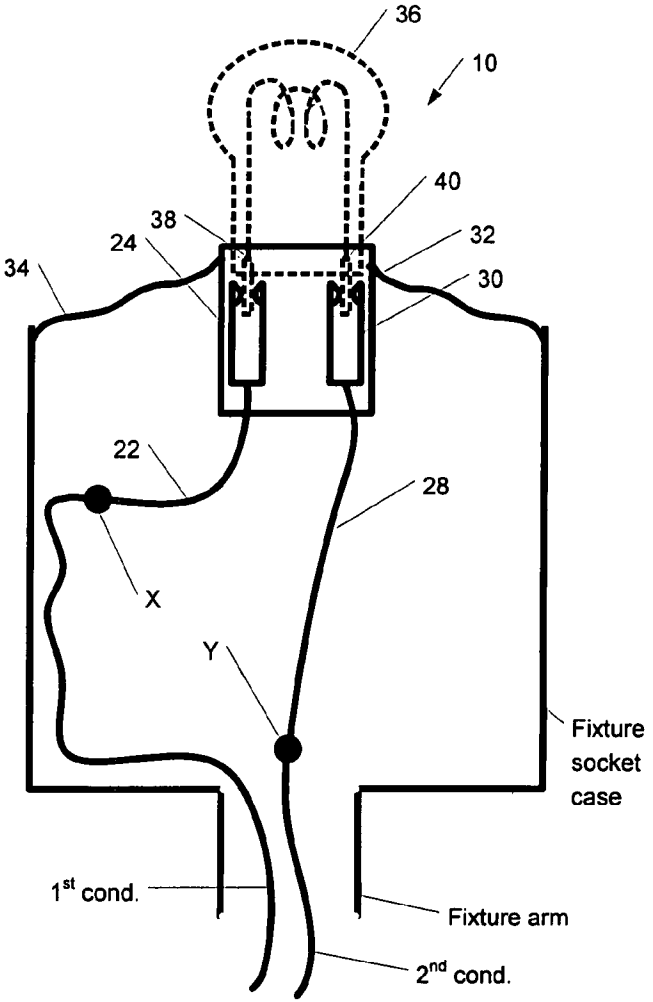
FIG. 12 is a cross-sectional view of yet another high voltage lighting fixture modified to be used in the low voltage lighting system.

FIG. 12 is a cross-sectional view of yet another modified high voltage lighting fixture to be used in the low voltage lighting system.

The above description of manufacturing the high voltage to low voltage, power adapter is exemplary and is not to be considered as limiting. While the invention has been described in terms of various specific embodiments, those skilled in the art will recognize that the invention can be practiced with modification within the spirit and scope of the claims.

What is claimed is:

1. A method for manufacturing a 115-volt to low voltage lighting fixture adapter, said method comprising:

providing a housing with a cavity having an interior base contact and a interior thread contact;

supplying a low voltage light source socket having two electrical contacts wherein each electrical contact is connected to a first conductor and a second conductor respectively;

connecting the first conductor to the interior thread contact;

connecting the second conductor the interior base contact; and securing the first conductor, the second conductor and the low voltage light source socket within the cavity of the housing.

2. The method according to claim 1 wherein said step of providing further comprises:

providing a Edison base fuse having a fuse metal inside;

removing a top cap of the Edison base fuse;

severing a connection between the fuse metal and the interior base contact; and severing a connection between the fuse metal and the interior thread contact.

3. The method according to claim 1 wherein said step of providing further comprises:

providing a Edison base light source having a filament inside;

removing encasement from the Edison base light source;

severing a connection between the filament and the interior base contact; and severing a connection between the filament and the interior thread contact.

4. The method according to claim 1 wherein said step of securing further comprises securing the electrical contacts inside the housing while maintaining sufficient spacing to make the electrical connection between a low voltage light source and the electrical contacts.

5. The method according to claim 1 further comprising performing continuity test to ensure electrical continuity.

* * * * *